United States Patent [19]

Lester

[11] Patent Number: 4,678,968

[45] Date of Patent: Jul. 7, 1987

[54] HIGH INTENSITY DISCHARGE LAMP STARTING AND OPERATING APPARATUS

[75] Inventor: James N. Lester, Rockport, Mass.

[73] Assignee: GTE Products Corporation, Danvers, Mass.

[21] Appl. No.: 702,107

[22] Filed: Feb. 15, 1985

[51] Int. Cl.[4] ..... H05B 37/00

[52] U.S. Cl. ..... 315/290; 315/221; 315/223; 315/244; 315/DIG. 2; 315/DIG. 5

[58] Field of Search ..... 315/221, 223, 219, 244, 315/290, DIG. 2, DIG. 5

[56] References Cited

U.S. PATENT DOCUMENTS

| | | | |
|---|---|---|---|
| 1,955,519 | 4/1934 | Vawter | 315/221 |
| 2,392,192 | 1/1946 | Robinson | 315/223 |
| 2,901,670 | 8/1959 | Sunstein | 315/219 |
| 3,334,270 | 8/1967 | Nuckolls | 315/244 |
| 3,753,037 | 8/1973 | Kaneda et al. | 315/99 |
| 4,209,730 | 6/1980 | Pasik | 315/244 |

*Primary Examiner*—Harold Dixon

*Attorney, Agent, or Firm*—Thomas H. Buffton; Edward J. Coleman

[57] ABSTRACT

Starting and operating apparatus for high intensity discharge lamps includes first and second pairs of terminals formed for connection to an AC source and a discharge lamp respectively, a series connect ballast means and inductor connected to one of said first pair and one of said second pair of terminals a bilateral switch shunted by a capacitor and in series with an AC impedance coupled to the inductor and to the other one of said first and second pair of terminals whereby relatively wide high voltage, high frequency pulse potentials for starting the discharge lamps are provided.

23 Claims, 6 Drawing Figures

HIGH INTENSITY DISCHARGE LAMP STARTING AND OPERATING APPARATUS

TECHNICAL FIELD

This invention relates to apparatus for starting and operating high intensity discharge lamps and more particularly to apparatus for converting relatively high currents to high voltages for starting and operating high intensity discharge lamps.

BACKGROUND ART

Some high intensity discharge lamps, mercury lamps for example, can start without the use of a starter if the open circuit voltage available from a ballast is relatively high. Other high intensity discharge lamps, such as high pressure sodium lamps, have employed simple pulse type starters for years. Normally, the existing starters operate from a 60-cycle voltage available from a ballast and primarily function to break down the gas within the discharge lamp.

Newer high intensity discharge lamps, metal halide lamps in particular, contain large amounts of free iodine which has a natural affinity for electrons. This iodine quickly absorbs the energy contained within a narrow voltage pulse such as provided by the better known forms of starters available. Thus, in order to insure adequate breakdown of such discharge lamps, it becomes necessary to increase either the peak pulse voltage, the peak pulse voltage width or the peak pulse voltage repetition frequency if the necessary increased energy is to become available. The peak voltage that a starter is allowed to generate depends on the lamp socket and circuit wiring. This limit is typically 4000 volts. Since there are readily available starters with peak pulse voltages rated up to 4000-volts which fail to start the above-mentioned newer types of high intensity discharge lamps, it was determined that increases in the peak pulse voltage width and/or the peak pulse voltage repetition rate were necessary if starting of the newer type lamps was to be effected.

Once having achieved breakdown of the high intensity discharge lamp, high levels of voltage and current are required to continue conductivity of the lamp for the period required to effect a shift from a glow condition to an arc condition. Thus, the provision of the above-mentioned relatively wide peak pulse voltages having relatively high pulse repetition rates becomes necessary to insure the desired starting of the lamp. Moreover, inadequate starting energy can undesirably leave a lamp in a glow state whereupon rapid electrode erosion results or the lamp will undesirably flash and go out which is also deleterious to electrode life. Thus high levels of energy are necessary to maintain lamp operation.

Other conditions which may occur due to the lack of a sufficient supply of energy include lamps which may light and conduct on only one-half cycle due to cathode imbalance. Thereupon, the ballast tends to saturate and supply the lamp with currents as high as 10 to 20 times the rated lamp current for many cycles which obviously can be damaging to the electrodes.

Also, it is desirable for a starter to function with either a lead ballast, such as a capacitor and small inductor or a lag ballast such as an inductor. With a lead or primarily capacitive type ballast, a parallel injection type starter tends to provide energy which is absorbed by the power line. Accordingly, reference is made to U.S. Pat. No. 3,753,037 issued to Kaneda. In contrast, a series injection starter does not see the power line as a load and therefore does not inject energy back into the power line.

OBJECTS AND SUMMARY OF THE INVENTION

An object of the present invention is to overcome the deficiencies of known discharge lamp starting and operating apparatus. Another object of the invention is to provide high intensity discharge lamp starting and operating apparatus which minimizes the generation of continuous electrical interference. Still another object of the invention is to provide high intensity discharge lamp starting and operating apparatus whereby lamp starting and operation are enhanced. A further object of the invention is to provide apparatus for starting and operating high intensity discharge lamps whereby currents are converted to relatively high energy voltages and applied to the discharge lamp.

These and other objects, advantages and capabilities are achieved in one aspect of the invention by first and second pairs of terminals coupled to an AC voltage source and a high intensity discharge lamp respectively, a series connected ballast means and inductor connected to one of the first pair and one of the second pair of terminals and a bilateral switch shunted by a charge storage means and in series connection with an AC impedance coupled to the junction of the ballast means and inductor and to the other one of the first and the second pair of terminals.

BEST MODE FOR CARRYING OUT THE INVENTION

For a better understanding of the present invention, together with other and further objects, advantages and capabilities thereof, reference is made to the following disclosure and appended claims in connection with the accompanying drawings.

Figure 1:
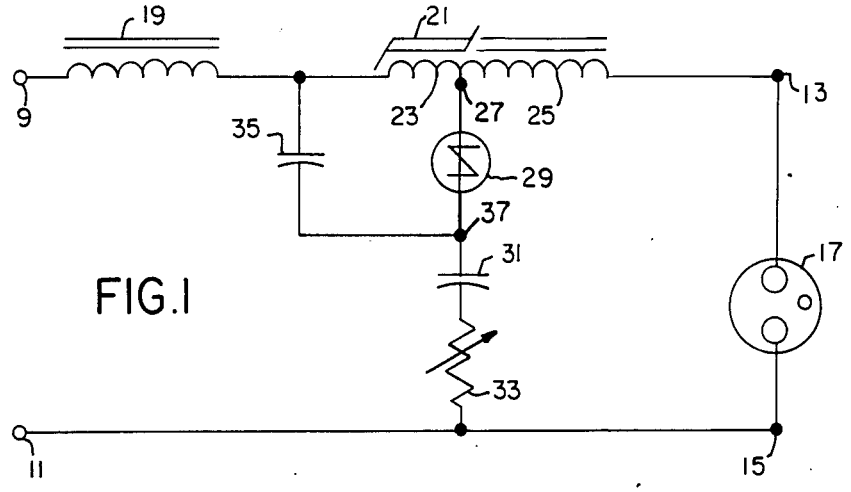
FIG. 1 is a diagrammatic illustration of a preferred form of starting and operating apparatus of the invention.

Referring to FIG. 1 of the drawings, a preferred apparatus for starting and operating high intensity discharge lamps includes a first pair of terminals 9 and 11 formed for connection to an AC voltage source such as a 220$^{v}$ AC source. The apparatus also includes a second pair of terminals 13 and 15 formed for connection to a high intensity discharge lamp 17 such as a metal halide lamp, a high pressure sodium lamp, a mercury vapor lamp, etc.

A ballast means 19, illustrated as an inductor, and a transformer 21 having primary and secondary windings 23 and 25 and a tap 27 series connect one 9 of the first pair of terminals 9 and 11 to one 13 of the second pair of terminals 13 and 15. A bilateral switch 29, preferably a sidac because of its current carrying capabilities, is connected to the tap 27 of the transformer 21. An AC impedance 31, illustrated as a capacitor, but may be in the form of an inductor or resistor, and a thermal cutout device 33 are in series connection with the bilateral switch 29 and connected to the other one 11 and 15 of the first and second pairs of terminals. Also, a charge storage means 35 or second capacitor is connected to the junction 37 of the series connected ballast means 19 and transformer 21 and to the junction 39 of the bilateral switch 29 and AC impedance 31.

Figure 2:
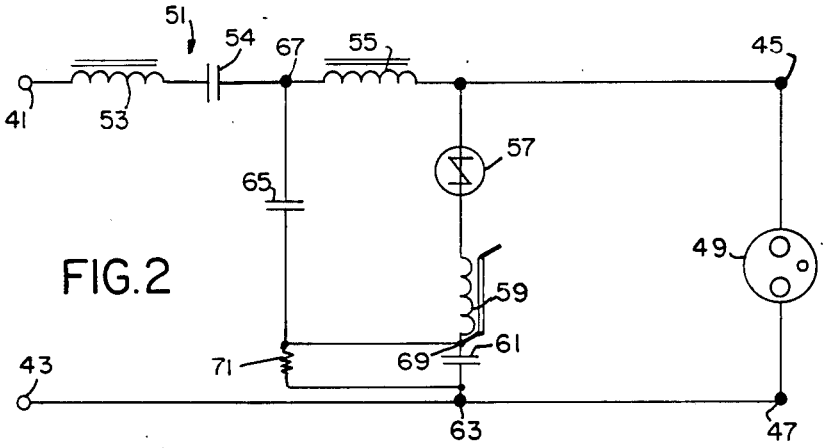
FIG. 2 is a diagrammatic illustration of an alternative form of starting and operating apparatus of the invention.

In an alternative embodiment, FIG. 2, the first pair of terminals 41 and 43 are connectable to an AC voltage source while the second pair of terminals 45 and 47 are connectable to the high intensity discharge lamp 49. A ballast means 51 in the form of a series connected inductor 53 and capacitor 54 is in series connection with an inductor 55 intermediate one, 41 of the first and one 45 of the second pairs of terminals.

A semiconductor bilateral switch 57 is connected to one end of the inductor 55 and one 45 of the second pair of terminals 45 and 47 and in series connection with another inductor 59 and capacitor 61 coupled to a junction 63 of the other one 43 of the first and second pairs of terminals 43 and 47. Also, a capacitor 65 is coupled to the junction 67 of the ballast means 51 and inductor 55 and to the junction 69 of the series connected inductor 59 and capacitor 61. Moreover, a resistor 71 is shunted across the capacitor 61 and coupled to the capacitor 65. Thus, the secondary winding 25 of FIG. 1 may be omitted for applications requiring only about 1000 to 2000-volts. Moreover, the thermal cutout device, 33 of FIG. 1, may also be omitted if automatic cutout is not desired.

Figure 3:
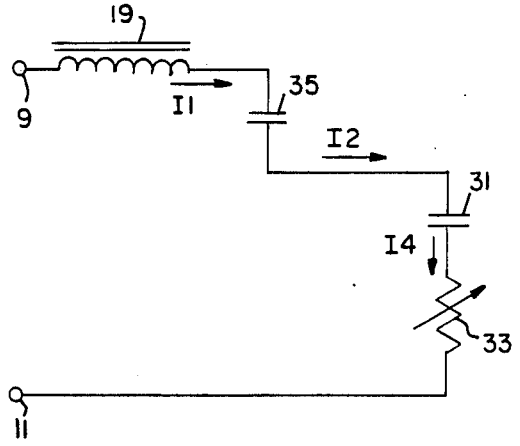
FIGS. 3–6 are diagrammatic illustrations of the operational phases of the embodiment of FIG. 1.

As to operation, FIG. 3 illustrates the apparatus of FIG. 1 when power is first applied to the terminals 9 and 11. Initially, the capacitors 35 and 31 are in a discharged state while the bilateral switch 29 and arc discharge lamp 17 are in an off or non-conductive state. The capacitors 35 and 31 begin to charge by way of the ballast inductor 19 with the charging voltage appearing mainly across the capacitor 35 because the impedance of the capacitor 35 is much larger than the impedance of the capacitor 31. Thus the current I2 through the capacitor 35 is substantially equal to the current I1 of the ballast inductor 19.

Figure 4:
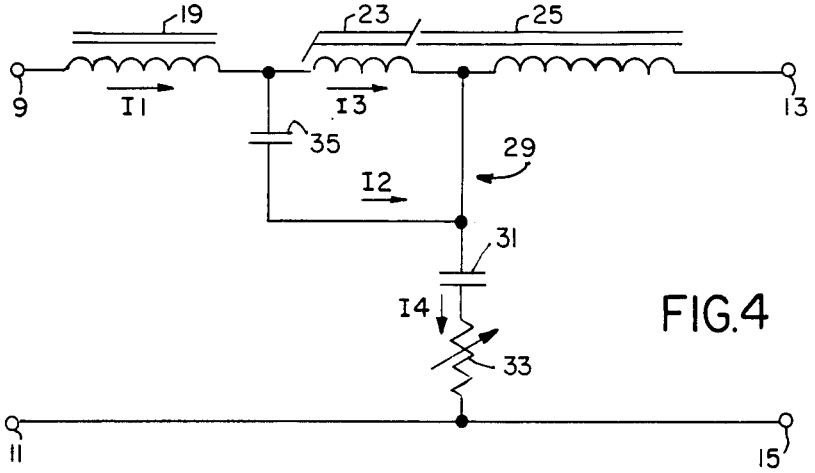

The voltage developed across the capacitor 35 is impressed across the bilateral switch 29 by way of the primary winding 23 of the transformer 21. (FIG. 4) When the breakdown voltage of the bilateral switch 29 is reached, the resistance of the bilateral switch 29 will suddenly decrease causing the capacitor 35 to discharge through the saturable primary winding 23 and bilateral switch 29 in a resonant manner. After a delay, the current sensitive magnetic switch or primary winding 23 saturates allowing the capacitor 35 to charge to a maximum value through the winding 23.

Importantly, the core of the current sensitive magnetic switch or primary winding 23 will drop out of saturation when the resonating current approaches the next zero value (FIG. 4) turning off the bilateral switch 29 allowing for higher circuit oscillation frequencies than are obtainable with only the bilateral switch 29. The capacitor 35 is left in a fully reversed charged state which provides an additional "initial charged condition" for voltage boosting during the next oscillation cycle. In other words, the voltage across the capacitor 35 again begins to change in the original direction but the current and voltage of the capacitor 35 do not start at zero. Since the reverse charging of the capacitor 35 by way of the first untuned, uncritical oscillating path of the primary winding 23 and the bilateral switch 29 occurs quickly relative to the initial charging of the capacitor 35 via the ballast inductor 19, the current through the ballast inductor 19 does not change appreciably. In addition, the line voltage can be considered nearly constant since the frequency thereof is so much lower than the oscillation frequency of the first oscillating path for boosting the voltage of the capacitor 35.

Figure 5:
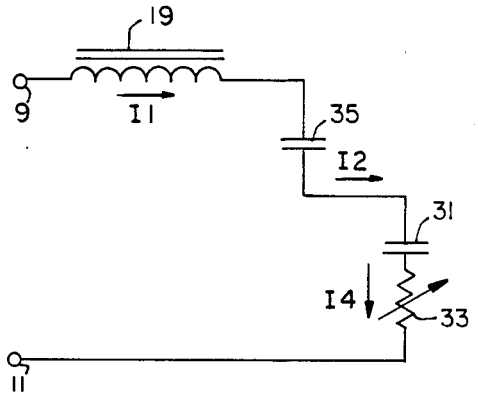

As the magnitude of the voltage across the capacitor decreases, the decreasing current in the primary winding 23 and the bilateral switch 29 drops below the holding current of the bilateral switch 29 and the bilateral switch 29 turns off. FIG. 5 The capacitor 35 again charges in the same direction and the current of the ballast inductor 19 increases slightly causing an increase in the final voltage across the capacitor 35. The cycle repeats with the capacitor 35 voltage and ballast inductor 19 current continuing to increase in value. Also, the voltage across the primary winding 23 is stepped up by the winding 25 to provide a high starting voltage for the discharge lamp 17. This high starting voltage is the sum of the voltages developed across the windings 23 and 25.

Figure 6:
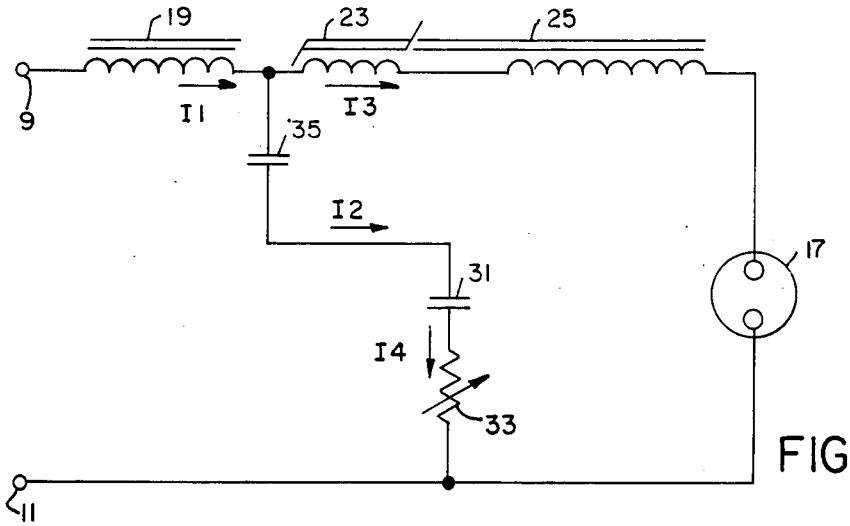

When the lamp 17 lights, a new or second resonant loop is formed, as illustrated in FIG. 6, and oscillation of the starter ceases due to the limiting of the voltage available to the bilateral switch 29. Since the saturated inductance of the primary winding 23 and winding 25 is orders of magnitude smaller than that of the ballast inductor 19, the new loop will now control the charging of the capacitor 35. Moreover, the breakdown voltage of the bilateral switch 29 is chosen to be greater than the peak voltage of the discharge lamp 17, therefore, no starting action will occur. At this time, of course, the high frequency starting mode of the circuit has been concluded, and steady state operation of the discharge lamp 17 from the AC source applied to terminals 9 and 11 (e.g., 220 V. 60 cycle) takes place with the lamp current being controlled by ballast 19.

It should be noted that the primary winding 23 performs a special function in that it acts as a magnetic switch. This magnetic switch action of the primary winding 23 insures that the discharge of the capacitor 35 does not take place before recharging thereof by way of the ballast inductor 19 is finished. The primary winding or magnetic switch 23 also helps to insure that the bilateral switch 29 turns off. When the voltage of the capacitor 35 reaches the breakover voltage of the bilateral switch 29, the bilateral switch 29 will turn on and the capacitor 35 will begin to discharge through the primary winding 23 which has a very high inductance until it saturates causing very little discharging of the capacitor 35 immediately after the bilateral switch 29 turns on.

Importantly, the low current unsaturated inductance of the primary winding 23 is similar to the inductance of the ballast inductor 19 while the high current saturated inductance of the primary winding 23 is much less than the inductance of the ballast inductor 19. Also, the capacitor 35 continues to change after the bilateral switch 29 turns on or becomes conductive by way of the ballast inductor 19 allowing the voltage across the capacitor 35 to build up. When the primary winding 23 saturates, it must have the capability to switch quickly and complete reverse charging of the capacitor 35. Accordingly, the best ferrite magnetic core materials for the transformer 21 which includes the primary and secondary windings 23 and 25 is a material with a sharp saturation knee characteristic.

While all of the above is happening, the line voltage and the voltage of the capacitor 31 continue to change so that oscillation is not quite continuous. However, so long as the line voltage and the voltage of the capacitor 31 are sufficiently different, oscillation will occur. Also, phase shifting of the modulated RF waveform will occur due to the relationship between line voltage, current and the voltage of the capacitor 31. Since the voltage on the capacitor 31 depends upon oscillator action, the circuit produces a somewhat random appearing modulated RF envelope. Moreover, the capacitor 31 further acts to limit starter current and hence output voltage since it is an AC impedance in series with the starter apparatus.

During this period, the thermal cutout device 33 self heats due to the series starter current passing therethrough and after a period of time, heats to a temperature sufficient to cause a sudden rise in resistance by several orders of magnitude. Thereupon, the starter current will greatly decrease and the generation of high voltage pulses will decrease. Thus, the thermal cutout device 33 will effectively shut off the starter should the lamp fail to light. The cutout device 33 stops self-heating when power is removed or the lamp lights and the starter is ready to instantly come alive if power is restored or the lamp goes out.

Thus, the starter system does not continue to apply high voltage pulse potentials to the discharge lamp 17 should it fail to ignite whereby deterioration of the discharge lamp circuit would result. However, the cutout device 33 does permit the starter system to immediately activate should a power outage occur. Moreover, an increase in lamp reignition voltage or an increase in reignition voltage due to lamp ageing will cause the automatic activation of the starter system to provide lamp power during powerline dips or voltage reignition humps occurring each half cycle of lamp voltage.

Accordingly, a compact, low cost electronic starter for converting low voltage, high current low frequency energy into high voltage, low current high frequency energy stored in an oscillator circuit operable at a frequency in the range of about 20 to 50 KHZ has been provided. The high voltage and current are provided simultaneously to effect rapid starting and re-starting of arc discharge lamps since a relatively wide high energy pulse, rather than narrow starting pulse potentials, is provided. Also, the starter acts in a series injection mode permitting the use of either lead or lag-type ballasts since the starter does not inject power back into the power line. Moreover, the capability to extend lamp life, to reignite the lamp upon failure of the source voltage and to protect the discharge lamp from bombardment by high voltage pulse potentials should the lamp fail to light are features unavailable in other known structures.

Additionally, typical, but in no way limiting, are the following component values for the embodiment of FIG. 1;

| | |
|---|---|
| L19 = | 0.5 H. |
| W23 = | 280.0 mh (unsaturated) |
| T-21 = | 2.2 mh (saturated) |
| = | 40:300T |
| I1 = | 0.4 A |
| I2 = | 10.0 A |
| C35 = | 0.008 MFD |
| C31 = | 2.0 MFD |
| Switch 29 = | Sidac Kl V 24 |
| Cutout device 33 = | 30 ohms cold |
| Lamp = | 40-watt metal halide |

-continued

| | |
|---|---|
| Osc. Frequency = | 40 KHZ |

While there has been shown and described what is at present considered the preferred embodiments of the inventions, it will be obvious to those skilled in the art that various changes and modifications may be made therein without departing from the invention as defined by the appended claims.

I claim:

1. A high intensity discharge lamp starting and operating apparatus comprising:

a first pair of terminals formed for connection to an AC voltage source;

a second pair of terminals formed for connection to a high intensity discharge lamp;

a series-connected ballast means and step-up transformer coupled to one of said first and one of said second pair of terminals, said step-up transformer having primary and secondary windings with a tap therebetween;

a series-connected bilateral switch and AC impedance coupled to said step-up transformer tap and to the other one of said first and the other one of said second pair of terminals; and a charge storage means coupled to the junction of said ballast means and step-up transformer and to the junction of said bilateral switch and AC impedance whereby relatively high currents are converted to relatively high voltages and applied to a high intensity discharge lamp, said primary winding of the step-up transformer including a saturable core whereby voltage buildup on said charge storage means is effected.

2. The starting and operating apparatus of claim 1 wherein said ballast means and charge storage means oscillate at a frequency in the range of about 20 to 50 KHZ.

3. The starting and operating apparatus of claim 1 wherein said bilateral switch has a breakdown voltage greater than the peak voltage of said high intensity discharge lamp.

4. The starting and operating apparatus of claim 1 wherein said ballast means is in the form of an inductor and said charge storage means is in the form of a capacitor.

5. The starting and operating apparatus of claim 1 wherein said AC impedance is in the form of a capacitor.

6. The starting and operating apparatus of claim 1 wherein said AC impedance provides energy for starting said discharge lamp.

7. The starting and operating apparatus of claim 1 including a thermal cutout device in series connection with said bilateral switch and AC impedance.

8. The starting and operating apparatus of claim 1 including a thermal output device in the form of a positive temperature compensated (PTC) device in series connection with said bilateral switch and AC impedance.

9. The starting and operating apparatus of claim 1 wherein said bilateral switch is in the form of a sidac.

10. The starting and operating apparatus of claim 1 wherein said AC impedance is in the form of an inductor.

11. The starting and operating apparatus of claim 1 wherein said AC impedance is in the form of a resistor.

12. Starting and operating apparatus for a high intensity discharge lamp comprising:

first and second pair of terminals formed for connection to an AC source and a high intensity discharge lamp respectively;

a ballast means connected to one of said first pair of terminals;

a first inductor coupling said ballast means to one of said second pair of terminals;

a series-connected bilateral switch and AC impedance means coupled to said first inductor and to the other one of said first and second pairs of terminals;

a charge storage means coupled to the junction of said ballast means and said first inductor and to the junction of said series-connected bilateral switch and AC impedance, whereby said charge storage means is coupled in a circuit loop with said bilateral switch; and a saturable core inductance connected in said circuit loop whereby voltage buildup on said charge storage means is effected.

13. The starting and operating apparatus of claim 12 wherein said discharge lamp comprises a metal halide discharge lamp.

14. The starting and operating apparatus of claim 12 wherein said ballast means comprises a second inductor.

15. The starting and operating apparatus of claim 12 wherein said charge storage means comprises a capacitor.

16. The starting and operating apparatus of claim 12 wherein said first inductor includes said saturable core inductance.

17. The starting and operating apparatus of claim 12 wherein said first inductor comprises a transformer having a tap with said tap connected to said series-connected bilateral switch and AC impedance means.

18. The starting and operating apparatus of claim 12 wherein said AC impedance comprises a capacitor.

19. The starting and operating apparatus of claim 12 wherein a thermal cutout device is in series connection with said series-connected bilateral switch and AC impedance.

20. The starting and operating apparatus of claim 12 wherein said ballast means comprises a series-connected second inductor and capacitor.

21. The starting and operating apparatus of claim 12 wherein said bilateral switch comprises a sidac.

22. The starting and operating apparatus of claim 12 wherein said bilateral switch comprises a solid state bilateral switch.

23. The starting and operating apparatus of claim 12 wherein conductivity of said bilateral switch forms a first oscillator circuit and non-conductivity of said bilateral switch effects formation of a second oscillator circuit.

* * * * *